US007434928B2

(12) United States Patent
Dohki

(10) Patent No.: US 7,434,928 B2
(45) Date of Patent: Oct. 14, 2008

(54) IMAGE FORMING APPARATUS

(75) Inventor: Yohzoh Dohki, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 393 days.

(21) Appl. No.: 11/225,722

(22) Filed: Sep. 13, 2005

(65) Prior Publication Data

US 2006/0061645 A1 Mar. 23, 2006

(30) Foreign Application Priority Data

Sep. 17, 2004 (JP) ..... 2004-271486

(51) Int. Cl.
*B41J 2/01* (2006.01)

(52) U.S. Cl. ..... 347/104; 400/636.3; 400/637.1; 400/639

(58) Field of Classification Search ..... 347/104; 400/636–641
See application file for complete search history.

(56) References Cited

U.S. PATENT DOCUMENTS 5,356,231 A * 10/1994 Nakamura et al. ..... 400/636
5,719,611 A * 2/1998 Nakamura et al. ..... 347/103
5,775,824 A * 7/1998 Bae ..... 400/636
6,877,854 B2 * 4/2005 Nishikawa ..... 347/104
7,090,419 B2 * 8/2006 Satoh et al. ..... 400/641
2006/0164464 A1 * 7/2006 Youn ..... 347/42

FOREIGN PATENT DOCUMENTS

JP 04164766 * 6/1992
JP 10-171205 6/1998
JP 2000-37916 2/2000

* cited by examiner

*Primary Examiner*—Matthew Luu
*Assistant Examiner*—Joshua M Dubnow
(74) *Attorney, Agent, or Firm*—Cooper & Dunham, LLP

(57) ABSTRACT

An image forming apparatus comprises a guide part guiding transportation of a recording medium after recording by a liquid droplet ejection head at a recording position, the guide part carrying plural spurs for holding the medium on which recording has been made at the recording position, the guide part being movable between a guide position in which the spurs are engaged with the recording medium and a release position in which the spurs are disengaged from the recording medium, wherein there is provided a protective member to the guide part such that the protective member is movable between a protective position protecting the spurs and a retracted position retracted from the spurs.

11 Claims, 16 Drawing Sheets

IMAGE FORMING APPARATUS

BACKGROUND

The present disclosure generally relates to recording of images and more particularly to an image forming apparatus.

An ink-jet recording apparatus is an image forming apparatus used extensively for printers, facsimile apparatuses, copying machines, and also in multifunctional apparatuses, which integrate therein a printer, a facsimile and a copying machine. Thereby, such an ink-jet recording apparatus carries out image formation including recording, printing, graphic printing, character printing, and the like, by using a liquid droplet ejection head as a recording head (image formation means). Such a recording head ejects droplets of recording liquid or ink droplets, and recording is made on a recording medium including paper, recording sheet, image transfer medium, or the like, while transporting the recording medium along a sheet feed path crossing a path of the recording liquid droplets. Thereby, the recording liquid droplets hit the moving surface of the recording medium and images are made on the surface of the recording medium with such recording liquid droplets.

With such an ink-jet recording apparatus, which forms images by ejecting the recording liquid droplets to the recording medium, it is configured such that the recording medium is transported by engaging a driving roller to a rear surface of the recording medium while holding a front surface of the recording medium, on which image formation has been made, by engaging thereto a spur. With this, cockling of the recording medium, which tends to occur immediately after image formation, is suppressed during the transportation or feeding of the recording medium.

Conventionally, Patent Reference 1 describes an ink-jet recording apparatus that uses such a spur, wherein Parent Reference 1 discloses the construction in which a recording sheet discharging roller and plural spurs are disposed at a downstream side of the recording sheet feed path with respect to the recording head. With this construction, plural spurs are held rotatably on a guide part that guides the recording sheet to be discharged, wherein this guide part is provided in the manner to take a release position. By setting the guide part to the release position, the foregoing spurs are disengaged from the recording sheet.

Further, Patent Reference 2 discloses an image forming apparatus including: an image formation medium carrying thereon a toner image formed with toner image formation means; an intermediate transfer medium of belt form transferred with the toner image on the image formation medium and carrying the toner image thus transferred on a surface thereof; first transfer means transferring the toner image on the image formation medium to a front surface of a transfer material, which is transported with the intermediate transfer medium; second transfer means transferring the toner image on the intermediate transfer medium to a rear surface of the transfer material; separation means for separating the transfer material; and fixing means for fixing the toner images transferred to both sides of the transfer material separated by the separation means, the second transfer means and the separation means forming unitary transfer and separation means, the image forming apparatus having a dividable structure formed of an upper part body and a lower part body.

Patent Reference 1 Japanese Laid Open Patent Application 2000-037916 official gazette Patent Reference 2 Japanese Laid-Open Patent Application 10-171205 official gazette

BRIEF SUMMARY

By using the construction that enables release of the guide part provided with the spurs as set forth in Parent Reference 1, maintenance, such as jam recovery or the like, of the image formation apparatus can be facilitated. However, with increase in the number of the spurs as in the case of recent image forming apparatuses capable of printing on the recording media of large size, there arises a problem in that large number of spurs are exposed when the guide part is released at the time of maintenance work. Thereby, maintenance work such as jam recovery may become difficult.

The present disclosure provides examples and exemplary embodiments of an image forming apparatus capable of facilitating maintenance work.

In an aspect of the present disclosure, an image forming apparatus is provided having a guide part carrying plural spurs in a feed path of a recording medium finished with image formation with the recording head, the guide part including plural spurs for holding the recording medium, such that the spurs are movable between a first position releasing the feed path and a second position guiding the recording medium, wherein there is provided a movable protective member to the guide part such that the movable protective member is movable between a protective position protecting the spurs and a retracted position retracted from the protection position.

Here, the protective member may be a plate member located at a side away from the sheet feed path relative to the guide part in the retracted position thereof. In this case, the plate member forming the protective member covers the circumferential surfaces of the spurs when the protective member is in the protective position. Alternatively, it is possible to construct the protective member in the form of a plate member locating at both sides of the spurs when the protective member is in the protective position. Further, it is possible to construct such that the protective member moves to the protective position by causing rotation.

Further, it is possible to construct the protective member such that the protective member faces the sheet feed path in the retracted position in a state receded from the spurs. In this case, it is preferable that the protective member moves to the protective position by causing displacement in the direction away from the guide part or in the direction along the guide part.

Further, it is preferable that the protective member moves to the protective position as a result of the weight of the protective member itself or as a result of engagement to or disengagement from other member when the guide part is moved from the guide position to a disengaged position. Alternatively, it is possible to construct the protective member of the guide part so as to be moved with manual operation.

According to an image forming apparatus, in an exemplary embodiment of the present invention, there is provided a protective member to the guide part so as to be able to cause displacement between a protective position protecting the spurs and a retracted position retracted from the protective position, and thus, it becomes possible to protect the spurs by the protective member in the state the guide part is set to a release position, and maintenance of the image forming apparatus is facilitated.

DETAILED DESCRIPTION OF THE INVENTION

First Embodiment

Figure 1:
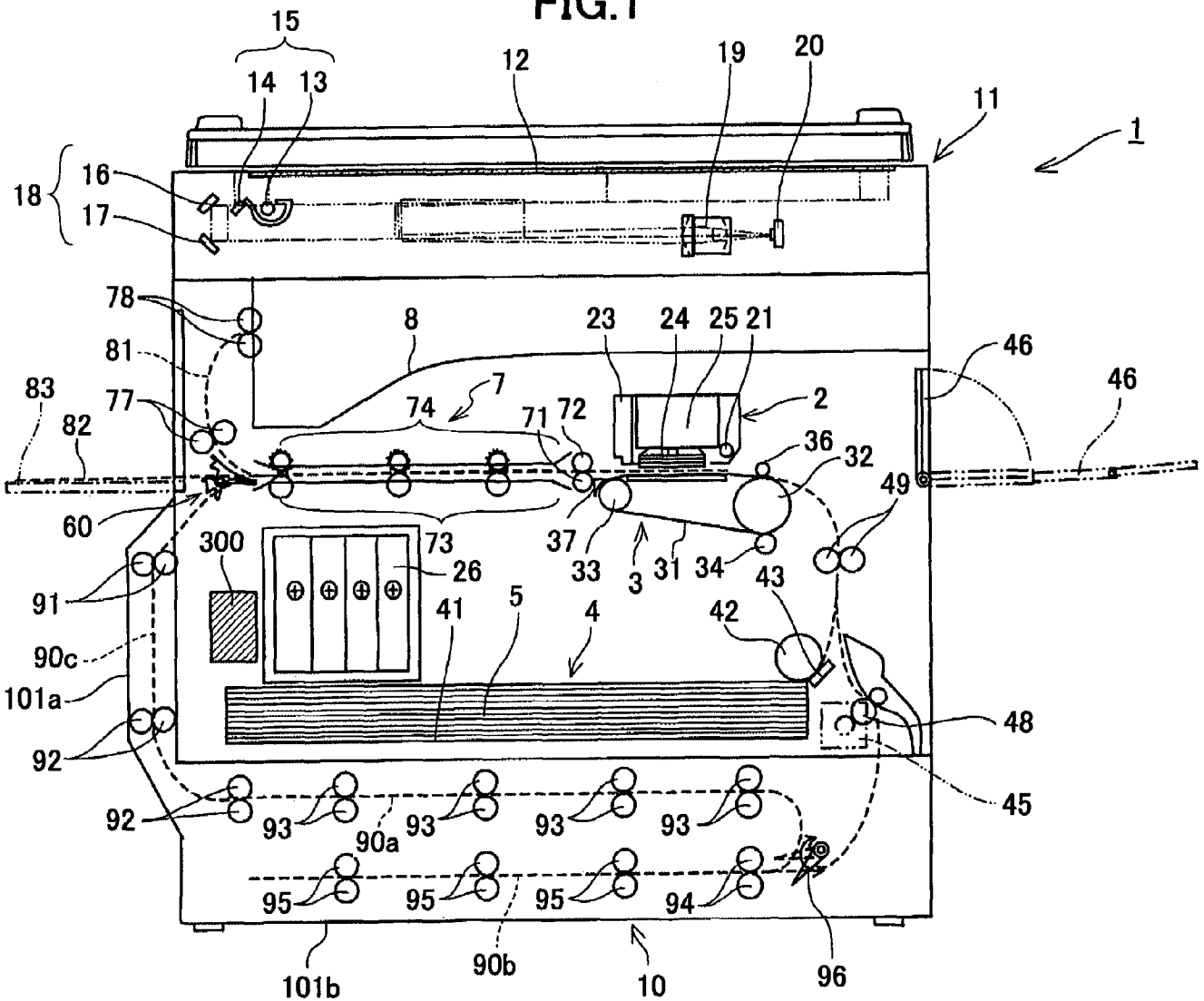
FIG. 1 is a diagram showing the outline of construction of an image forming apparatus according to the present invention.
Figure 2:
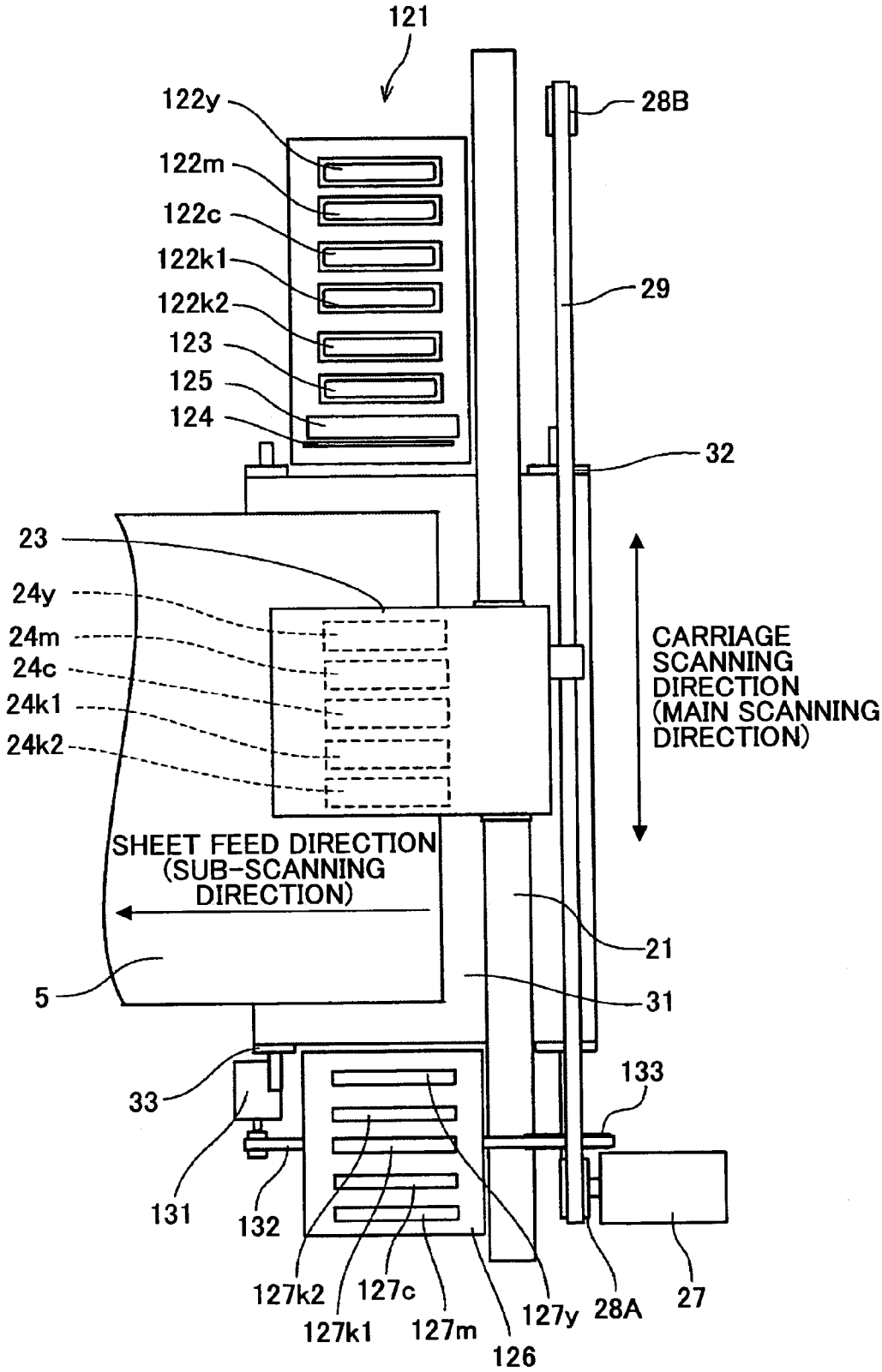
FIG. 2 is a plan view diagram showing an image formation part and a sub-scanning sheet feed part of the image forming apparatus of FIG. 1.
Figure 3:
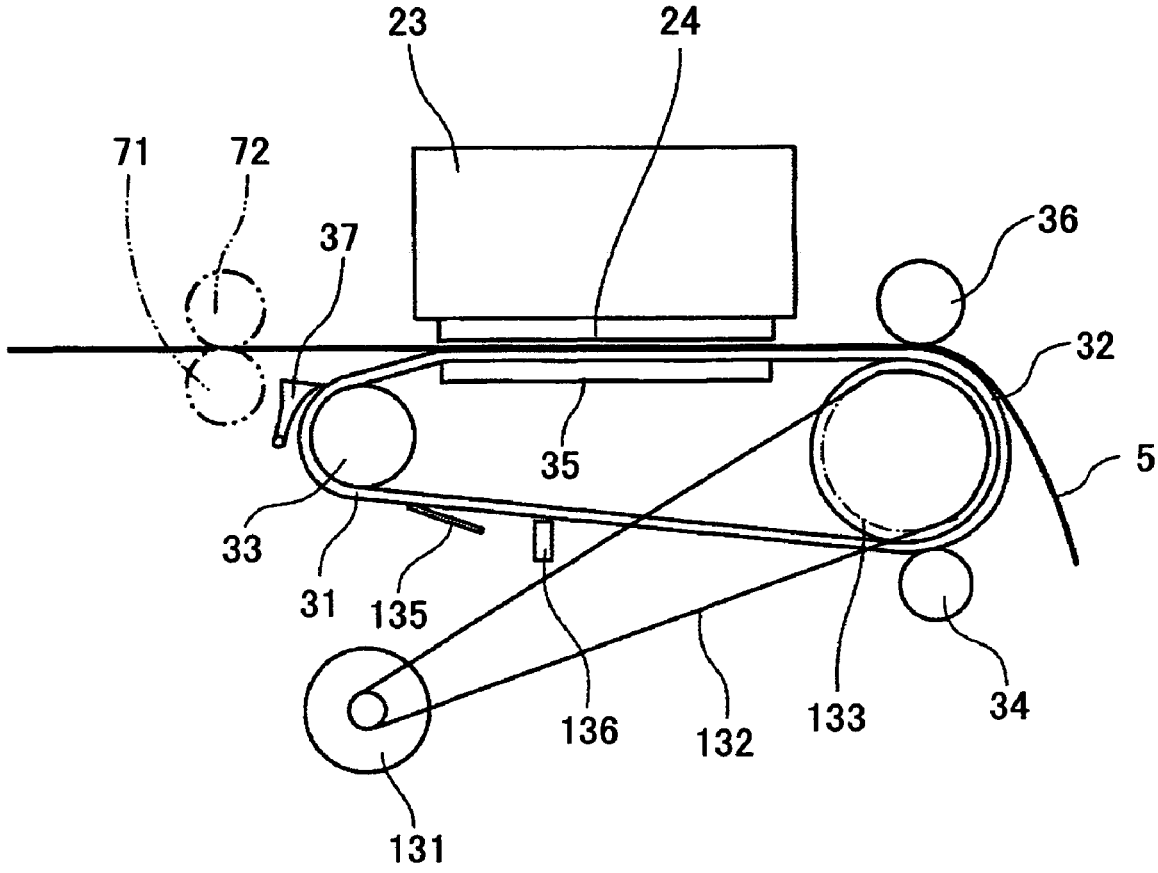
FIG. 3 is a side view diagram of the construction of FIG. 2.

Hereinafter, the outline of an image forming apparatus according to an embodiment of the present invention will be explained with reference to FIGS. 1 through 3, wherein FIG. 1 is a diagram showing the overall construction of the image forming apparatus of the present embodiment, FIG. 2 is a plan view diagram showing the construction of an image formation part and a sub-scanning sheet feeding part of the image forming apparatus of FIG. 1, and FIG. 3 is a side view diagram of the construction of FIG. 2.

Referring to the drawings, the image forming apparatus includes, in an interior of an apparatus main body 1 thereof, an image formation part 2 forming images and a sub-scanning and sheet feeding part 3, which feeds a recording sheet, wherein the sub-scanning and sheet feeding part 3 picks up a sheet 5 one by one from a sheet stack provided at a bottom part of the apparatus 1 and transports the same through a position facing the image formation part 2.

Thereby, the image formation part 2 records a desired image on the sheet 5 by ejecting liquid droplets, wherein the sheet 5 thus recorded with an image is discharged to an output tray 8 provided at a top part of the apparatus main body 1 via a sheet discharging part 7, provided that the image formation is made to only one side of the recording sheet 5 in correspondence to a single-side recording mode.

In the case of both side recording mode, on the other hand, the sheet 5 is diverted from the previously explained sheet feed path in the sheet discharging part 7 and is forwarded to a both-side feed unit 10 provided at a bottom part of the body 1 of the recording apparatus. Thereby, a switchback is made in the transportation of the sheet 5 in the unit 10 and the sheet 5 is fed to the sub-scanning and sheet feeding part 3 in a turned over state. Thereby, image formation is made also on the rear side of the sheet 5 by the image formation part 3 as the sheet is fed by the sub-scanning and sheet feeding part 3, and the sheet thus recorded with images at both sides is discharged to the output tray 8.

Further, this image forming apparatus is provided with an image reading part (scanner part) 11 above the output tray 8 of the apparatus main body 1 as an input system of image data (printing data) formed with the image formation part 2 for reading images.

This image reading part 11 reads the images of an original document placed on a contact glass, by causing to move a scanning optical system 15 including therein an illumination optical source 13 and a mirror 14 and another scanning optical system 18 including therein mirrors 16 and 17, wherein the images of the original document thus scanned is converted to an image signal by image an reading element disposed behind a lens 19. The image signal thus obtained is then digitized and subjected to image processing to produce printing image data ready for printing.

Further, the image forming apparatus can be supplied with printing data including therein image data from external input devices or host devices used as an alternative data input system of image data of the image formation part, such as information processing apparatuses including personal computers, imaging apparatus including image scanners, and picturing apparatuses including digital cameras, over a cable or network. Thereby, the image forming apparatus can print the received printing data after processing.

Meanwhile, with the image forming apparatus of FIG. 1, the image formation part 2 holds a carriage 23 movably in a main scanning direction by way of a guide rod 21 and a guide stay not illustrated as shown in FIG. 2, and the carriage 23 is caused to scan in the main scanning direction by a main scanning motor 27 via a timing belt 29 laid between a driving pulley 28A and a follower pulley 28B.

The carriage 23 carries thereon a recording head 24 of liquid droplet ejection heads ejecting the liquid droplet of respective colors, and image formation is conducted by causing ejection of the liquid droplets from the recording head 24 while moving the carriage 23 in the main scanning direction and while feeding the sheet 5 in the sheet feeding direction (sub-scanning direction). It is also possible to use a line printing head.

The recording head 24 is formed of five liquid droplet ejection heads collectively designated as "recording heads 24", wherein the five liquid droplet ejection heads includes: two liquid droplet ejection heads 24*k*1 and 24*k*2 each ejecting black (Bk) ink droplets; and liquid droplet ejection heads 24*c*, 24*m* and 24*y* respectively ejecting the ink droplets of cyan (C) colored ink, magenta (M) colored ink, and yellow colored ink (Y). Thereby, the inks of respective colors are supplied from corresponding sub-tanks 25, which are carried also on the carriage 23.

Further, as shown in FIG. 1, the image forming apparatus 1 can be loaded and unloaded with ink cartridges 26 of the respective colors of: black (Bk); cyan (C); magenta (M); and yellow at the front side of the apparatus main body as the recording liquid cartridge, wherein the ink cartridges 26 of the respective colors thus loaded supply the inks of respective colors to the corresponding sub tanks 25. It should be noted that the black ink is supplied from a single ink cartridge 26 to two sub tanks 25.

For the recording head 24, it is possible to use any of: a head of so-called piezoelectric type that uses a piezoelectric element for the pressure generator (actuator means) that pressurizes the ink in the ink passage (pressure generation chamber) by changing the volume of the ink passage by way of causing deformation in the vibration plate that constitutes the wall of the ink passage, for causing ejection of the ink droplets; a head of so-called thermal type that causes ejection of the ink droplets by generating bubbles by heating the ink in the ink passage by using a resistance heater; and a head of electrostatic type in which an electrode is disposed so as to face a vibration plate constituting the wall of the ink passage and ejection of the ink droplets is caused by changing the volume of the ink passage by way of causing deformation in the vibration plate by inducing an electrostatic force between the vibration plate and the electrode.

Further, there is provided a non-recording region at one side of the scanning region of the carriage 23, and there is provided a maintenance and recovery unit 121 in such a non-recording region as shown in FIG. 2 for maintaining and recovering the proper nozzle state of the recording head 24. It should be noted that this maintaining and recovery unit 121 comprises: five caps 122*k*2, 122*k*1, 122*c*, 122*m* and 122*y*, collectively designated as caps 122, for capping the respective nozzle surfaces of the five recording heads 24 for the purpose of maintaining humidity; a single suction cap 123; a wiper blade 124 for wiping the nozzle surface of the recording head 24; and a target member 125 for capturing dummy ejection of liquid droplets, which is conducted without formation of images.

Further, at another side of the scanning region of the carriage 23, there is provided a target member 125 as shown in FIG. 2 for capturing dummy ejection of liquid droplets caused by the five recording heads 24 without formation of images. It should be noted that this member 126 forms five openings 127*k*2, 127*k*1, 127*c*, 127*m* and 127*y* collectively designated as openings 127 in correspondence to the recording heads 24.

As shown in FIG. 3, the sub-scanning and sheet feeding part 3 comprises: an endless transportation belt 31 laid between a driving roller 32 used for a transportation roller and a follower roller 33 used for a tension roller for feeding the sheet 5 supplied from the downward side to the image formation part 2 by changing the feed direction by about 90 degrees; a charging roller 34 applied with a high AC. voltage from a high voltage source and charging the surface of the transportation belt 31; a guide member 35 for guiding the transportation belt 31 in the region facing the image formation part 2; a holding roller or pressurizing roller 36 urging the sheet 5 to the transportation belt 31 at the location opposite to the transportation roller 32; and a separation nail 37 for separating the sheet 5 recorded with images with the image formation part 2 from the transportation belt 31.

It should be noted that this transportation belt 31 circles around in the sheet feed direction (sub-scanning direction) of FIG. 2 with rotation of the transportation roller 32, wherein the rotation of the transportation roller 32 is caused by a sub-scanning motor 131 via a timing belt 132 and a timing roller 133. The transportation belt 31 has a two-layer structure of: a front surface layer of pure resin material not applied with resistance control such as ETFE pure material and forming a sheet suction surface; and a rear surface layer (mid-resistance layer or ground layer) of the same material to the front surface layer but applied with resistance control by carbon. Alternatively, the transportation belt 31 may have a single-layer structure or may be formed of three or more layers.

Further, between the follower roller 33 and the charging roller 34, there are provided cleaning means 135 of Myla sheet or the like for removing paper dust or the like deposited on the surface of the transportation belt 31, and a discharging brush 136 for removing the electric charges on the surface of the transportation belt 31.

The sheet feed part 4 comprises: a sheet feed cassette 41 removably inserted to the apparatus main body 1 from the front direction thereof, the sheet feed cassette 41 holding thereon a stack of sheets 5; and a sheet feed roller 42 and a friction pad 43 for feeding the sheet 5 in the cassette 41 one by one by separating from the stack.

Further, this sheet feed part 5 comprises: a manual feed tray 46; a manual feed roller not illustrated for feeding a sheet 5 from the manual feed tray 46; and a feed roller 48 for feeding a sheet 5 supplied from an optional sheet feed cassette provided at the bottom of the apparatus main body 1 or from the both-side feed unit 10, wherein the member such as the sheet feed roller 42 used for feeding the sheet 5 to the sub-scanning and sheet feed part 3 is driven by a sheet feed motor (driving means) 45 of HB-type stepping motor, via a sheet feed clutch not illustrated.

It should be noted that the sheet discharging part 7 comprises: a discharging roller 71 discharging the sheet 5 separated by the separation nail 37 of the sub-scanning and sheet feed part 3 and spurs 72 opposing the roller 71; a lower guide pat 73 and an upper guide part 74 transporting and guiding the sheet 5 discharged along the path between the discharging roller 71 and the spurs 72; and turn-over roller pairs 77 and turn-over discharging roller pairs 78 feeding the sheet 5 discharged along the path between the lower guide part 73 and the upper guide part 74 to the output tray 8 in the facedown state after turning over through a turn-over discharging path 81, which forms a first transportation path. Here, the path for transporting the sheet 5 between the lower guide part 73 and the upper guide part 74 will be designated as a transportation path 70.

Further, the sheet discharging part 7 includes a straight sheet discharge path 82 for transporting and discharging the sheet 5 provided with image formation straight in the face up state as a second transportation path, and thus, it becomes possible to discharge the sheet 5 transported along the path between the lower guide part 73 and the upper guide part 74 to a straight output tray (straight output cover) 83 provided to the other lateral side of the apparatus main body via the straight discharge path 82.

In order to switch the first discharge path 81, the second discharge path 82 and a both-side transportation path to be described below, there is provided a switching mechanism 60 at the exit side of the lower guide part 73 and the upper guide part 74.

The both-side feed unit 10 integrates therein: a vertical transportation part 101*a* forming a vertical both-side transportation path 90*c* accepting the sheet 5 transported with guiding by the switching mechanism 60 at the lateral side of the apparatus main body 1 and forwarding the same in the downward direction; and a horizontal transportation part 101*b* including therein a horizontal intake and transportation path 90*a* transporting the sheet 5 supplied from the vertical both-side transportation path 90*c* in the horizontal direction and a switchback transportation path 90*b*.

The vertical both-side transportation path 90*c* is provided with an entrance roller pair 91 transporting the sheet 5 supplied thereto in the downward direction and feeding roller pair for feeding the sheet 5 supplied thereto to the horizontal intake and transportation path 90*a*. The horizontal intake and transportation path 90*a* is provided with five both-side transportation roller pairs 93, while the switchback transportation path 90*b* is provided with a both-side exit roller 94 of a reverse roller provided for turning back the sheet 5 supplied from the intake transportation path 90*a* for re-feeding and three both-side transportation roller pairs 95.

Further, there is provided a diverting plate 96 in a manner to cause swinging operation for switching the feed path of the sheet 5 between the path from the intake transportation path 90*a* to the switchback transportation path 90*b* and the re-feeding path from the switchback transportation path 90*b* to the transportation roller pair 48. It should be noted that the diverting plate 96 swings between the switchback position shown in FIG. 1 by a continuous line and the reefed position shown in FIG. 1 by a broken line.

Further, while not illustrated, there is provided an image start sensor for detecting the top edge of the sheet 5 in the image formation part 2 at the upstream direction of the sheet feed direction and a image end sensor for detecting the bottom edge of the sheet 5 at the downstream side of the sheet feed direction.

Figure 4:
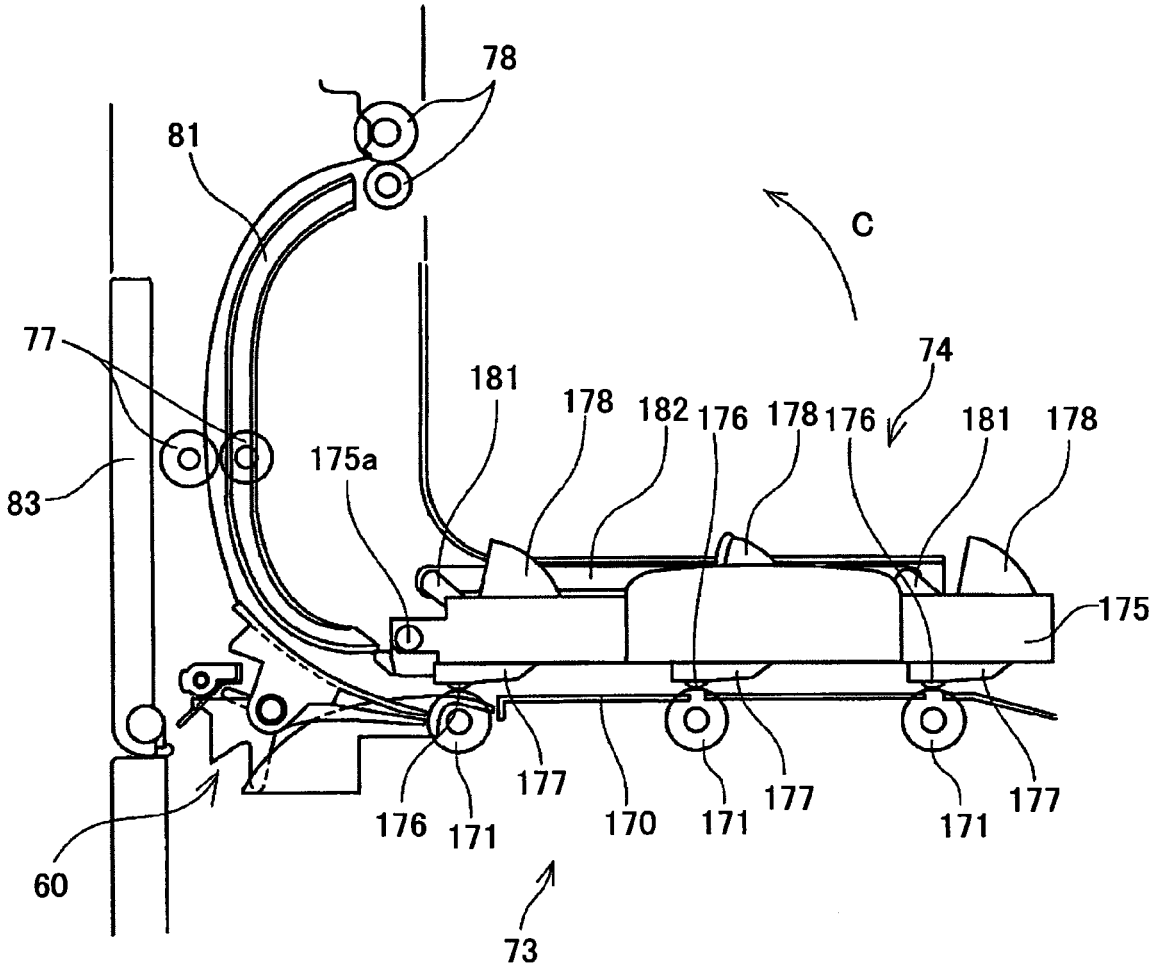
FIG. 4 is a side view diagram showing a sheet guide part used with the image forming apparatus of FIG. 1 in the state a upper guide part thereof is engaged.
Figure 5:
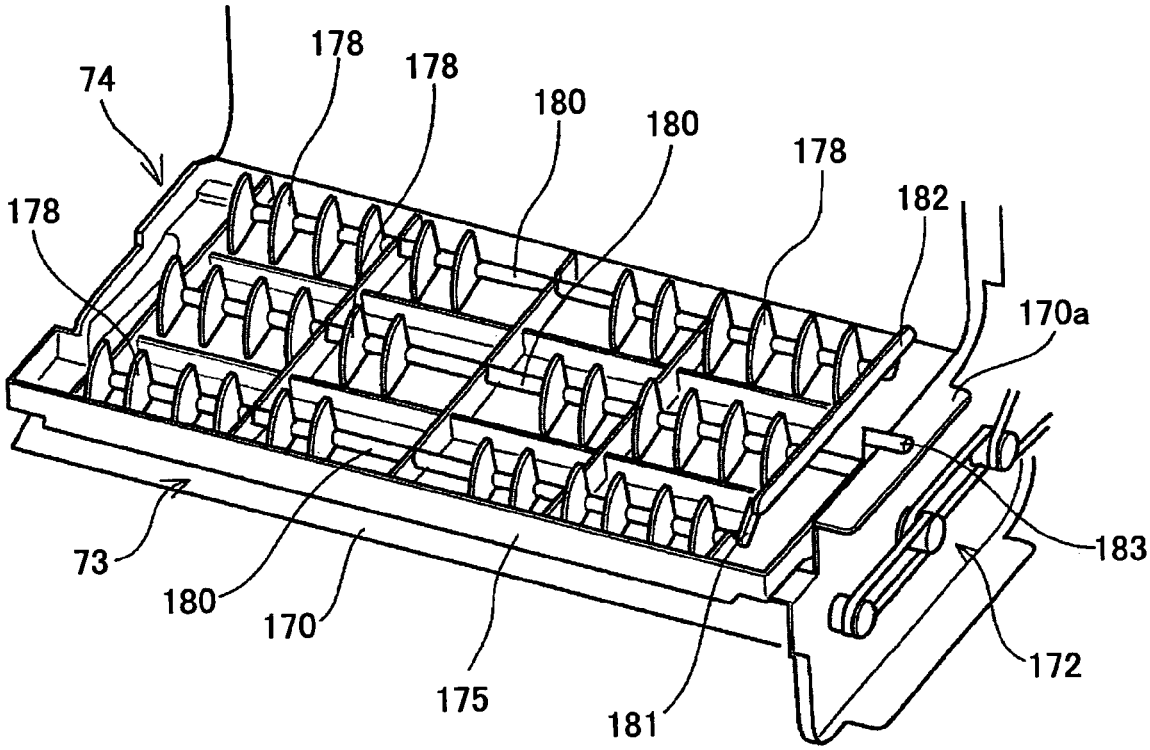
FIG. 5 is an oblique view diagram showing the same sheet guide part of FIG. 4 in the state the upper guide part thereof is engaged.
Figure 6:
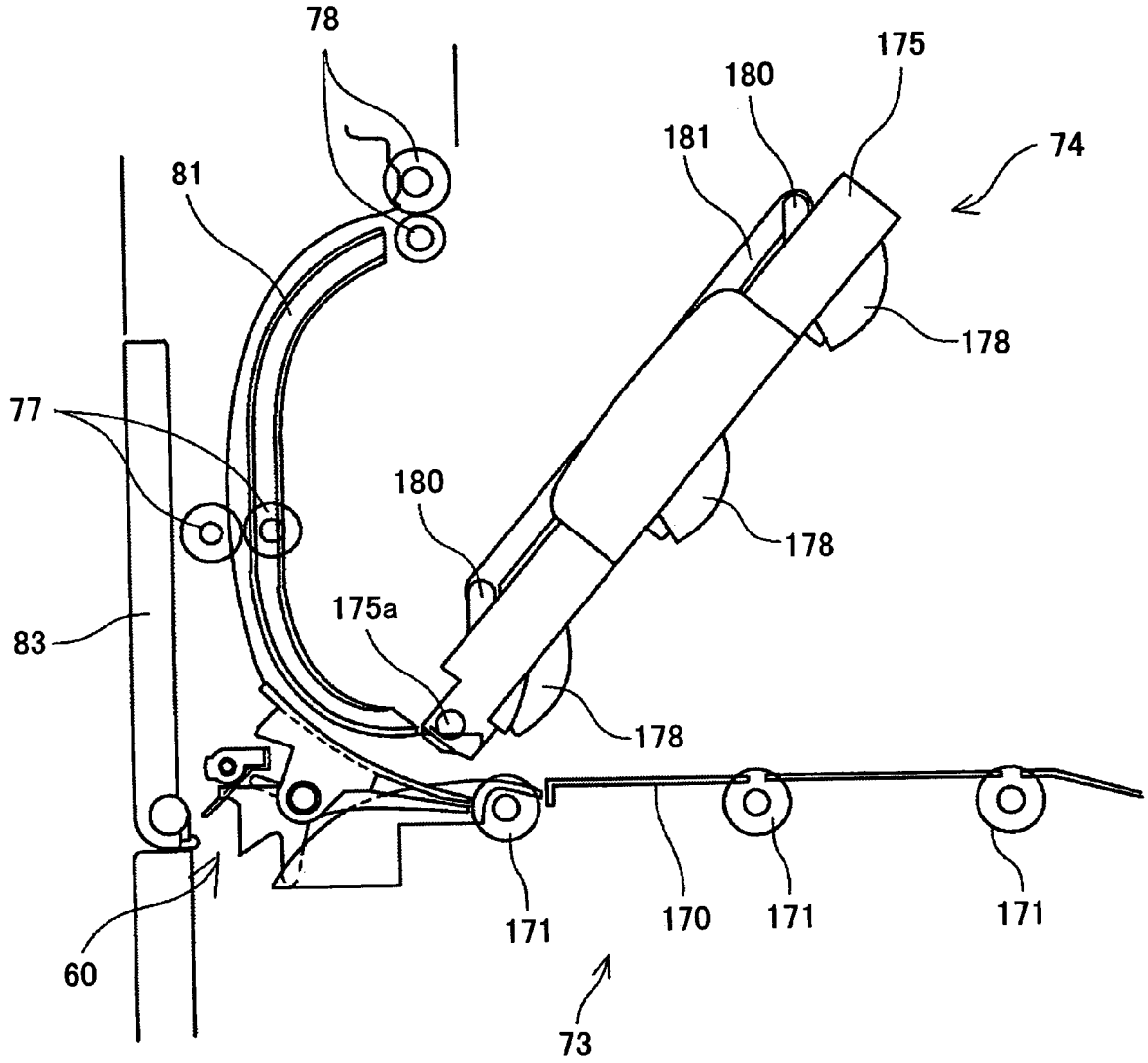
FIG. 6 is a side view diagram showing the sheet guide part in the state the upper guide part thereof is released.
Figure 7:
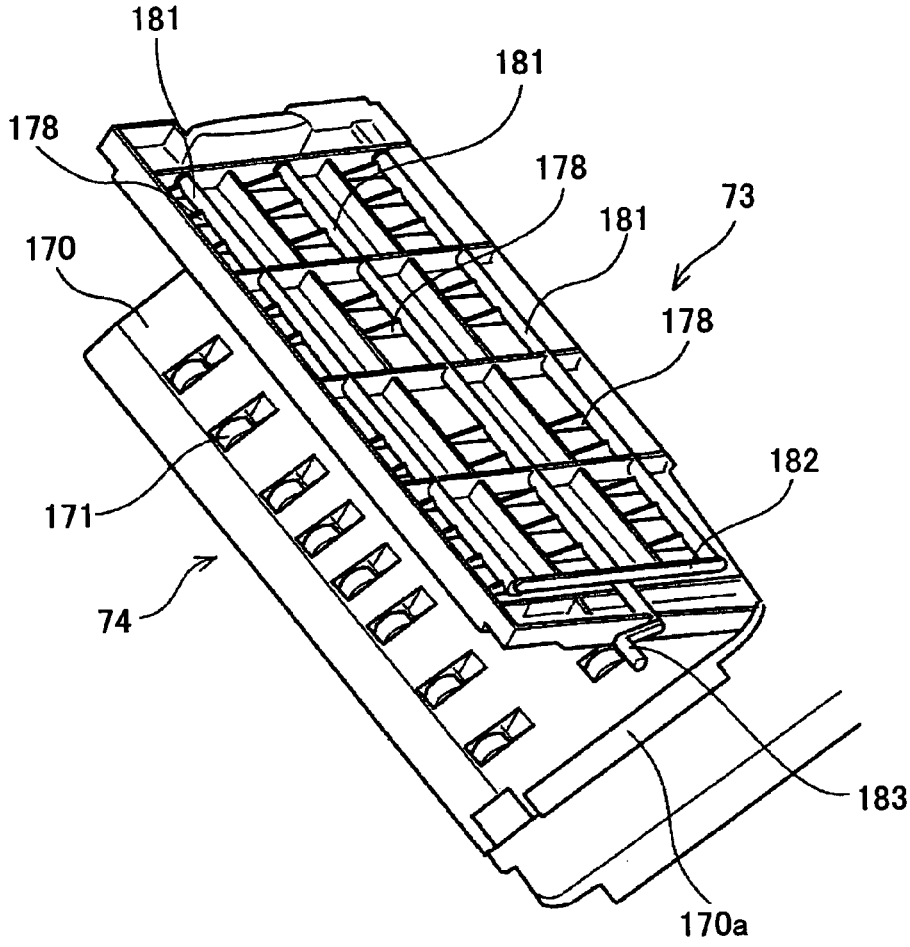
FIG. 7 is an oblique view diagram showing the same sheet guide part of FIG. 6 in the state the upper guide part thereof is released.
Figure 8:
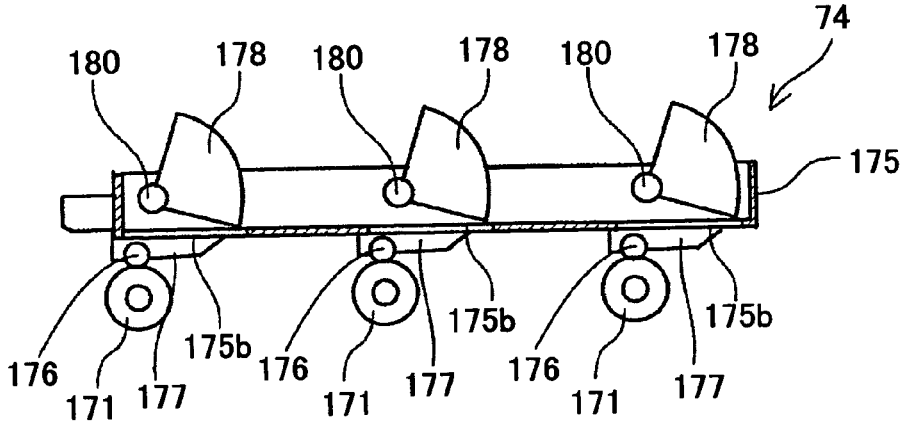
FIG. 8 is a schematic side view diagram showing the sheet guide part in the state the upper guide part thereof is engaged.
Figure 9:
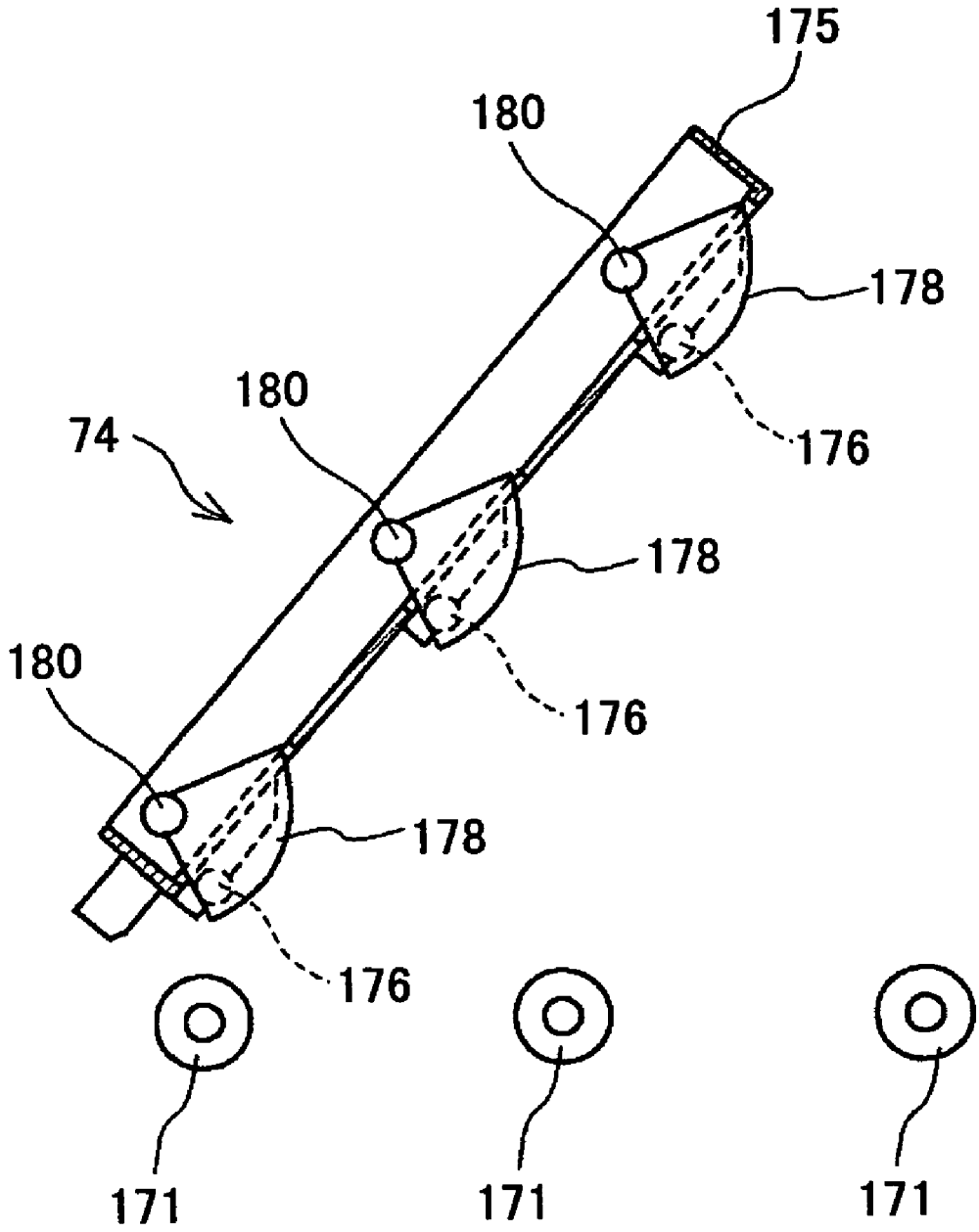
FIG. 9 is a schematic side view diagram showing the sheet guide part in the state the upper guide part thereof is released.
Figure 10:
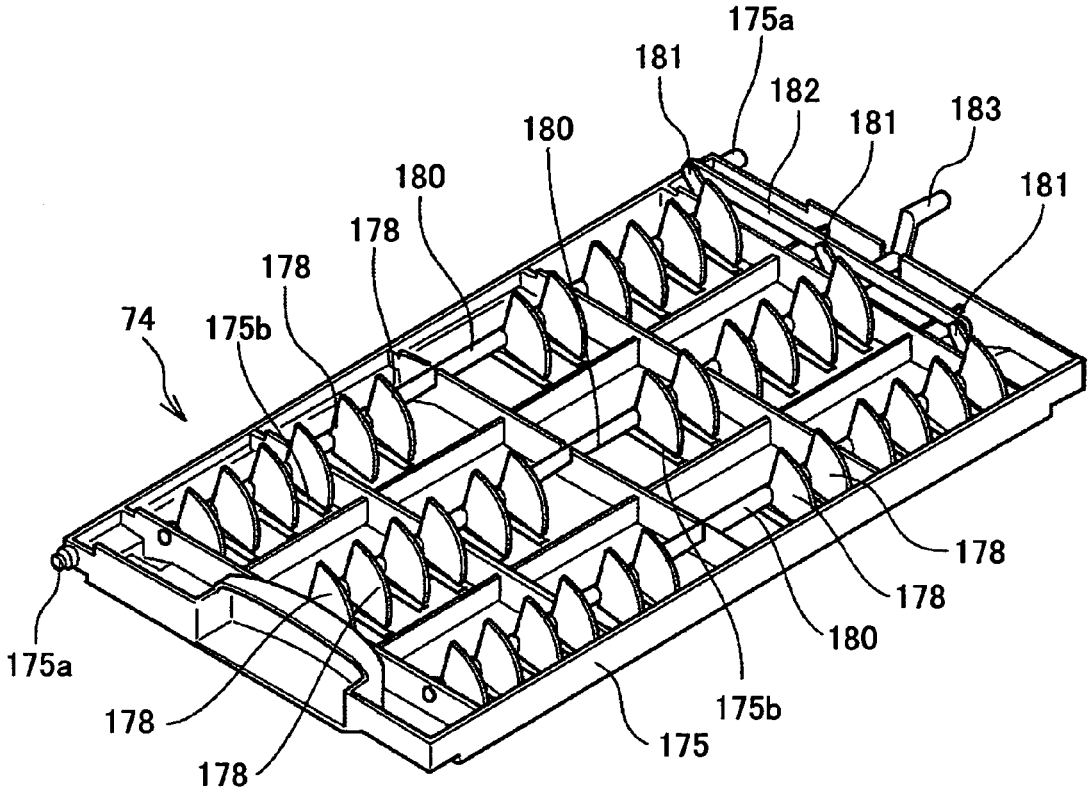
FIG. 10 is an oblique view diagram as viewed from an upward direction showing the upper guide part of the sheet guide part in the guiding position thereof.
Figure 11:
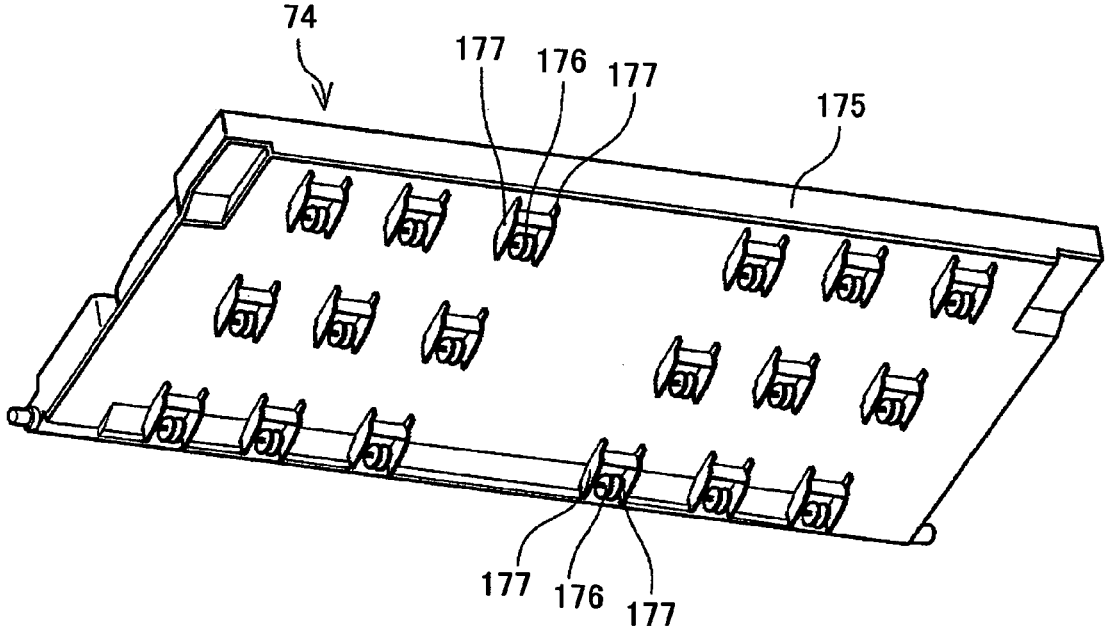
FIG. 11 is an oblique view diagram as viewed from a bottom side showing the same upper guide part of FIG. 10.
Figure 12:
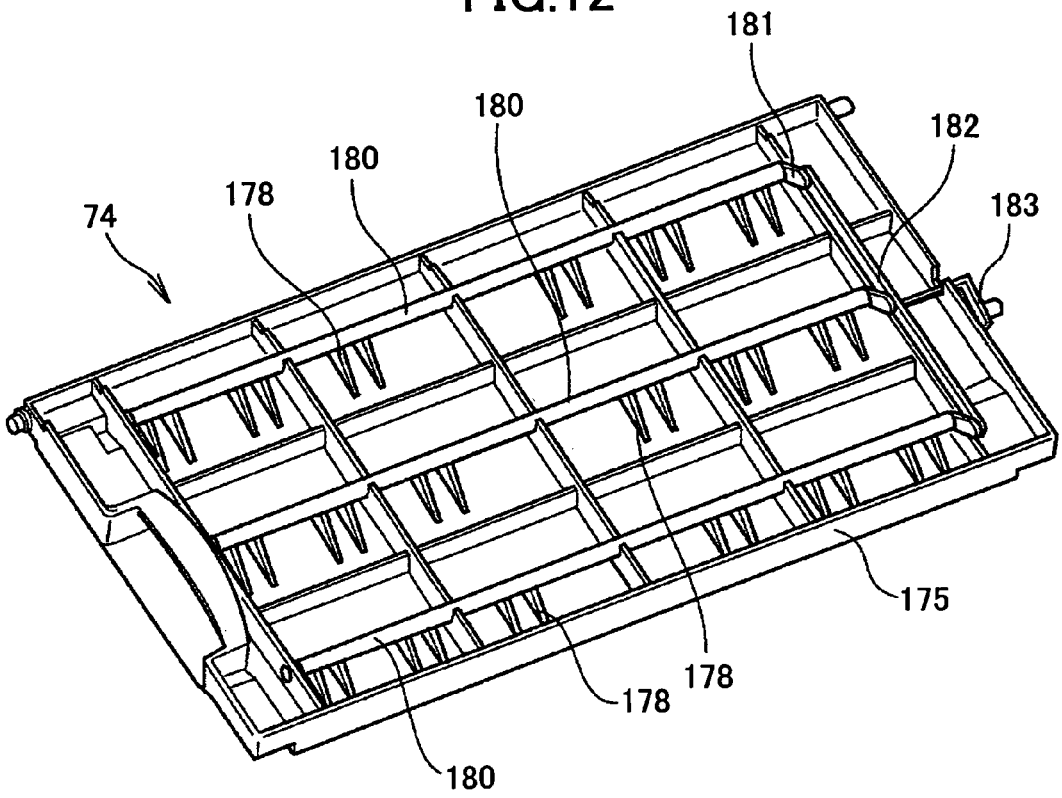
FIG. 12 is an oblique view diagram as viewed from an upward direction showing the upper guide part of the sheet guide part in the release position thereof.
Figure 13:
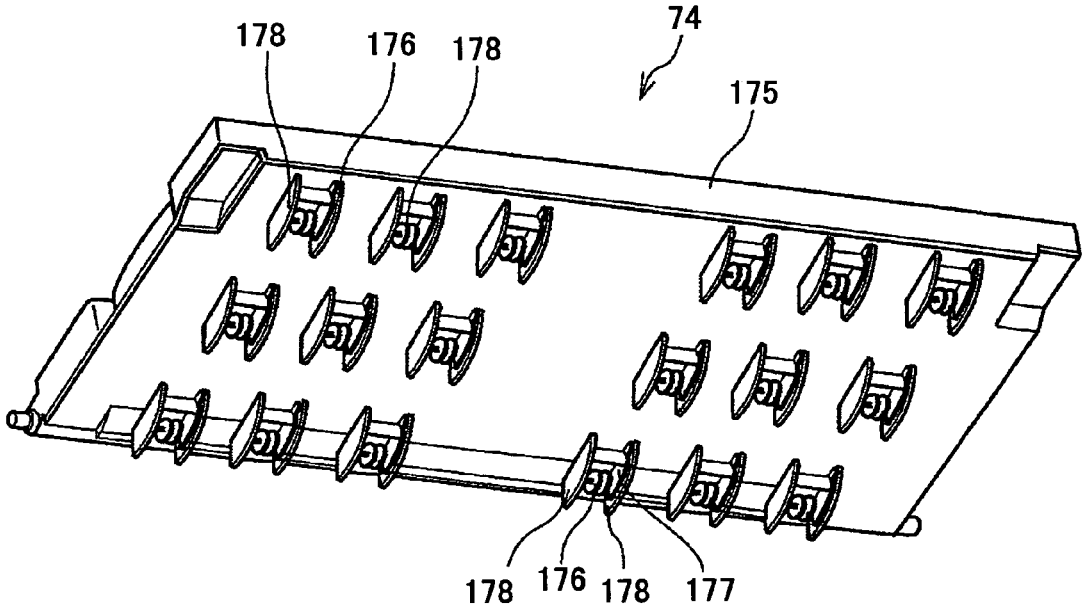
FIG. 13 is an oblique view diagram as viewed from the downward direction showing the same upper guide part of FIG. 12.

Next, the lower guide part 73 and the upper guide part 74 of the sheet discharging part 7 will be explained in detail with reference to FIGS. 4-13, wherein FIG. 4 is a side view diagram showing the sheet discharging part 7 in the state the upper guide part 74 is closed; FIG. 5 is an oblique view diagram showing the sheet discharging part 7 in the state the upper guide part is closed; FIG. 6 is a side view diagram showing the sheet discharging part 7 in the state the upper guide part 74 is released; FIG. 7 is an oblique view diagram showing the sheet discharging part 7 in the state the upper guide part 84 is released; FIG. 8 is a schematic cross-sectional diagram showing the state in which the upper guide part 74 is closed; FIG. 9 is a schematic cross-sectional diagram in which the upper guide part is released; FIG. 10 is an oblique view diagram as viewed from an upward direction showing the upper guide part 74 is in the closed position; FIG. 11 is an oblique view diagram as viewed from a downward direction showing the upper guide part 74 in the state of FIG. 10; FIG. 12 is an oblique view diagram as viewed from an upward direction showing the upper guide part 74 is in the release position; while FIG. 13 is an oblique view diagram as viewed from a downward direction showing the upper guide part 74 is in the state of FIG. 12.

The lower guide part 73 includes a guide member 170 for guiding the bottom surface of the sheet 5 to be transported and transportation rollers 171 provided in plural rows (three rows in the present example) for feeding the sheet 5, wherein the rollers in each row are aligned in the direction perpendicular to the sheet feed direction. Further, the transportation roller 171 is driven by a driving source not illustrated via a power transmission mechanism 172 that uses a belt and pulley as shown in FIG. 5.

The upper guide part 74 includes, at the bottom side of a frame 175 thereof (at the side of the transportation path 70), a guide member 177 comprised of: plural spurs 176 free for rotation and holding the top side of the sheet 5 transported through the transportation path 70 by the transportation roller 171; and guide members 177 guiding the sheet 5 at both lateral sides of each spur 176 at a retracted position to the spur 176, wherein the guide member 177 functions also as a spur support plate.

This upper guide part 74 is thereby pivoted in a swinging manner at a pivot 175*a* provided on the fame 175 at the downstream side of the sheet feed direction. Thereby, the guide part 74 can move between a position clearing the transportation path 70 called "release position" as shown in FIG. 6, and a position for guiding the sheet 5 called "guiding position" shown in FIG. 4 in which the spurs 176 can engage with the transportation roller 171.

Further, the upper guide part 74 includes protective members 178 of a plate-like component, such that the protective members 178 are in a retracted position retracted from both lateral sides of the spurs 176 when the upper guide part 74 is set to the guide position and such that the protective members 178 proceed to a "protective position" at both lateral sides of the spurs for protecting the spurs 176 when the upper guide part 74 is in the release position.

Thus, at the top side of the frame 175, there are provided three rotatable support shafts 180 in correspondence to the three rows of the transportation rollers, and the protective members 178, each having a sector shape, are provided on the circumference surface of the support shafts 180 at the respective locations corresponding to both lateral sides of the spurs 176. Thereby, the three support shafts 180 are connected to a common link member 182 via respective link members 182, while the common link member 182 is provided with a lever 183.

It should be noted that this lever 183 is capable of making contact with the top flange part 170*a* of the guide member 170 of the lower guide part 73 as shown in FIG. 5, and thus, the protective members 178 are caused to rotate to the retracted position shown in FIGS. 4, 5, 8 and 10 in the state the upper guide part 74 is in the guide position shown in FIG. 5 as a result of engagement of the lever 183 with another member such as a top flange part 170*a*.

When the upper guide 74 is moved to the release position the engagement of the lever 183 and the top flange part 170*a* is canceled (disengaged) as shown in FIG. 7, and the protective members 178 cause rotation to the protective position protecting the spurs 176 at both respective sides thereof with the self gravity as shown in FIGS. 6, 7, 9, 12 and 13, through openings 175*b* formed in the frame 175.

With such a construction, the upper guide part 74 is merely lifted up, in the event jamming of sheet 5 is caused in the transportation path 70 of the sheet discharging part 7, in the direction of arrow C to the release position from the guide position shown in FIGS. 4 and 6 such that the sheet transportation path 70 is exposed as a result of separation of the upper guide part 74 from the lower guide part 73. Thereby, removal of the jammed sheet is achieved easily. Thereby, it is preferable to provide a mechanism for locking the upper guide part 74 at the release position.

Further, in this state, the protective members 178 proceed to the protective position thereof at the lateral sides of the spurs 176 by causing rotation in the right direction in FIG. 4 in the downward reaction of the frame 175 as a result of disengagement of the lever 183 from the flange part 170*a*. In this state, the protective members are moved to a forward position of the peripheral surface of the spurs 176, and protection is made to the spurs 176 with the protective members 178. With this, the problem of the jammed paper being caught by the spurs 176 during removal process thereof is eliminated, and maintenance of the image forming apparatus is facilitated.

Second Embodiment

Figure 14:
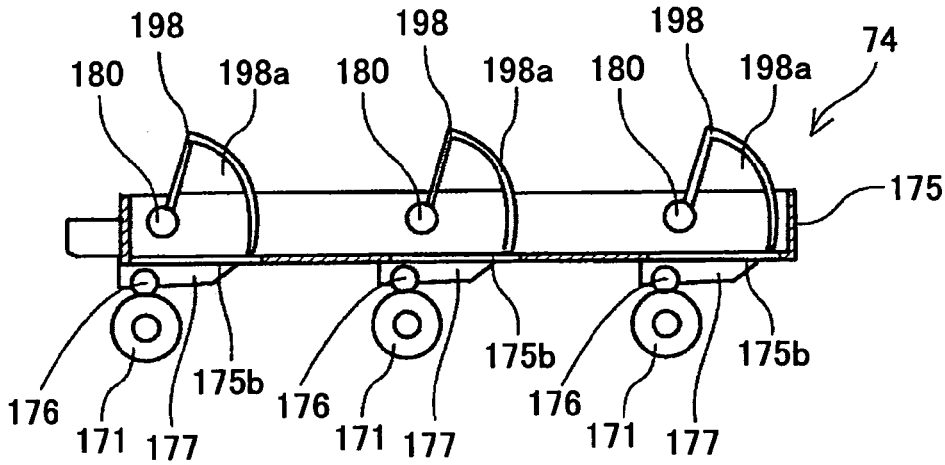
FIG. 14 is a schematic cross-sectional diagram showing the sheet feed part according to a second embodiment in the state the upper guide part is engaged.
Figure 15:
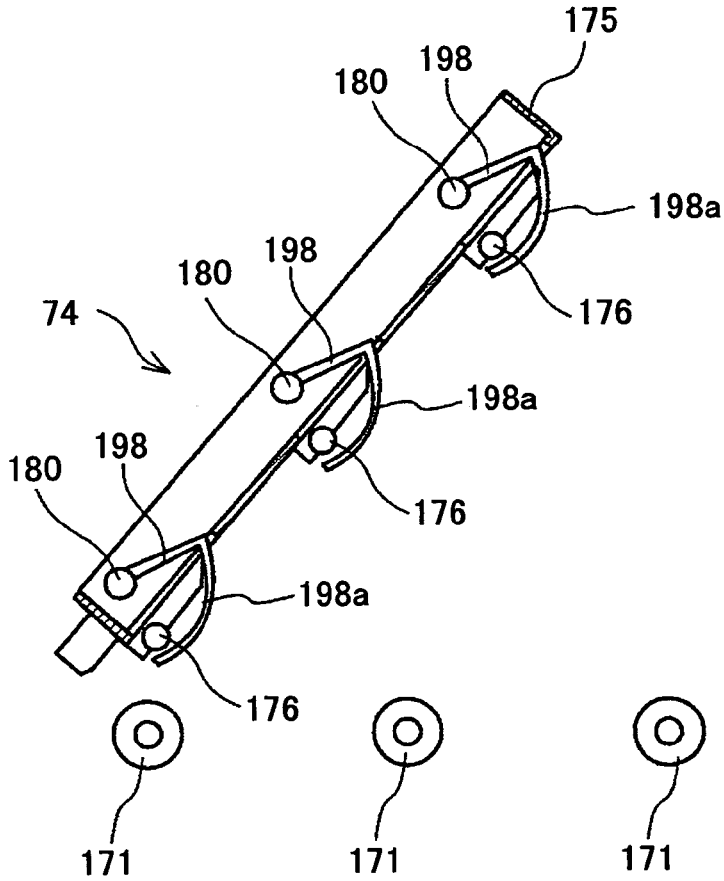
FIG. 15 is a schematic cross-sectional diagram showing the sheet feed part of FIG. 14 in the state the upper guide part is released.
Figure 16:
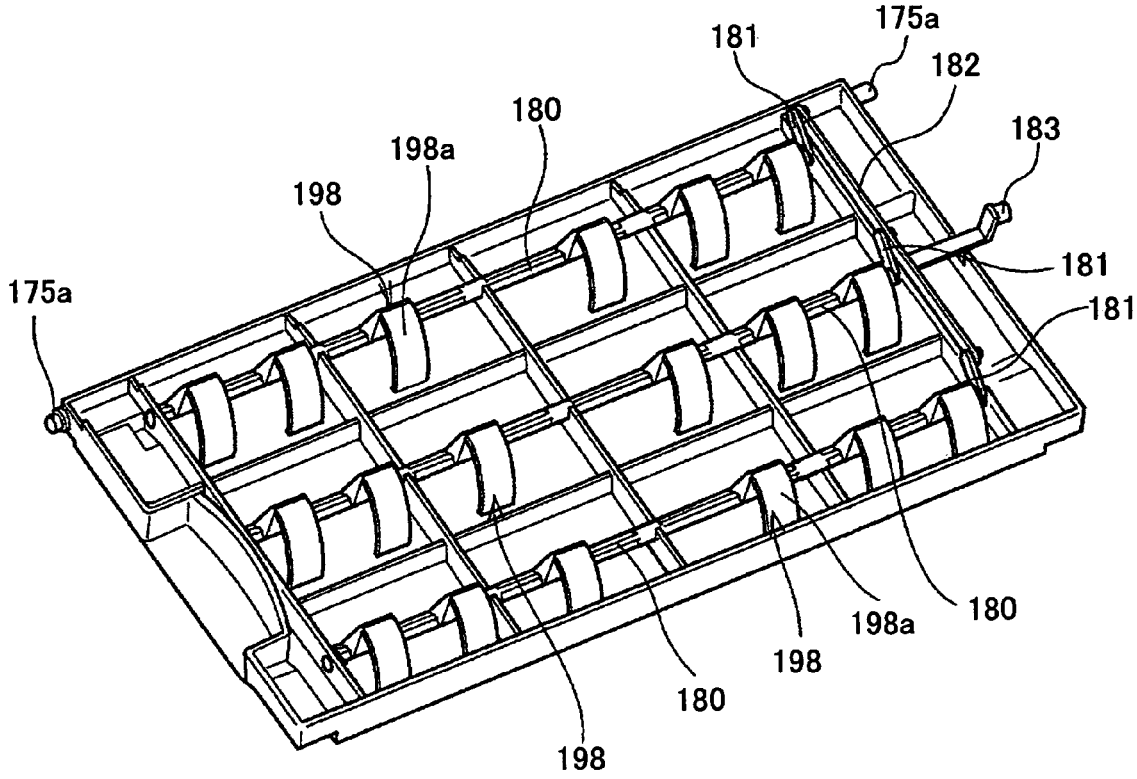
FIG. 16 is an oblique view diagram as viewed from the upward direction showing the upper guide part in the guiding position.
Figure 17:
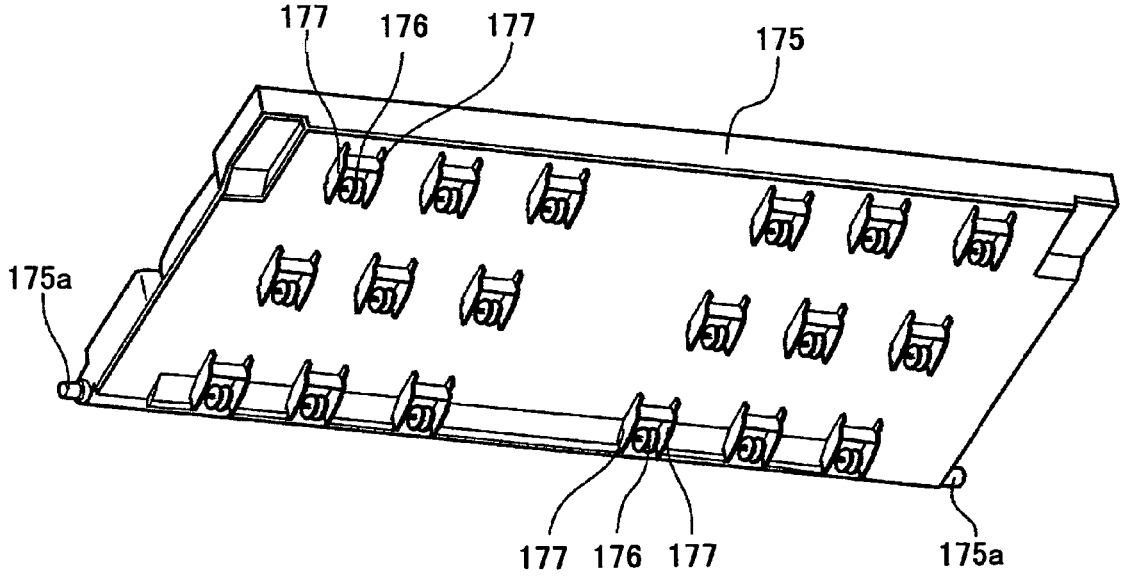
FIG. 17 is an oblique view diagram as viewed from a downward direction showing the same upper guide part of FIG. 16.
Figure 18:
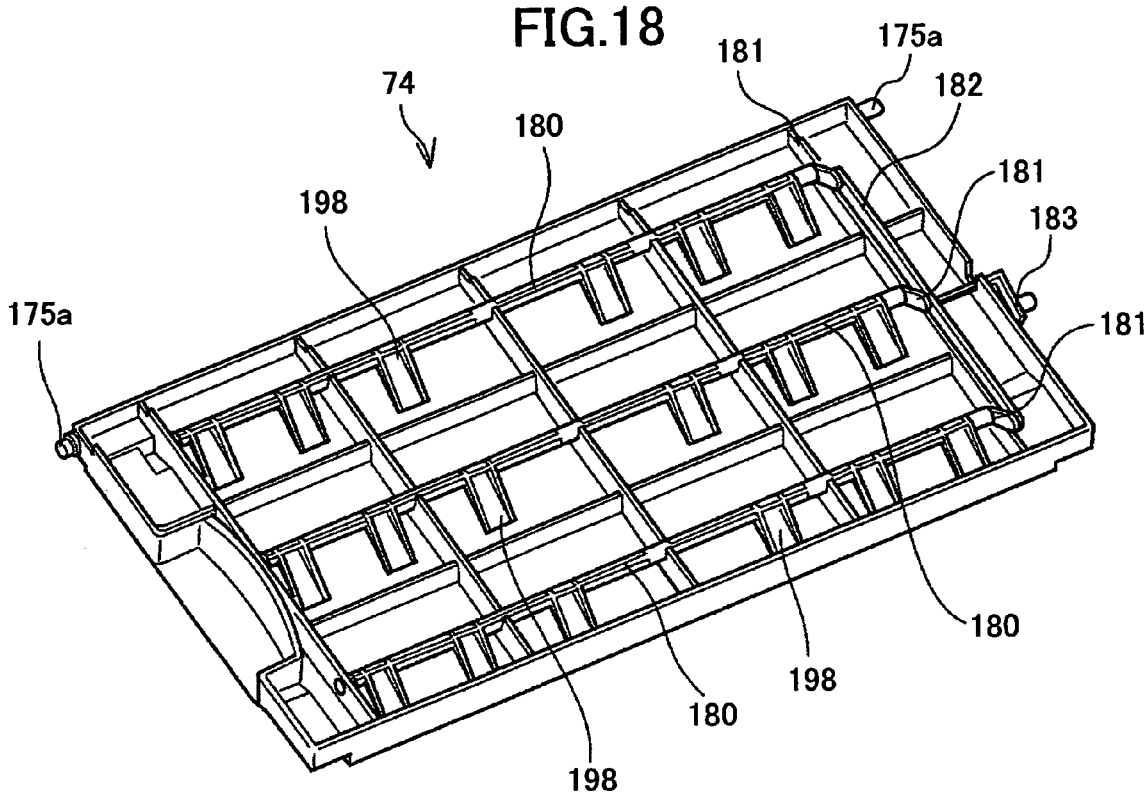
FIG. 18 is an oblique view diagram as viewed from an upward direction showing the upper guide part in the release position.
Figure 19:
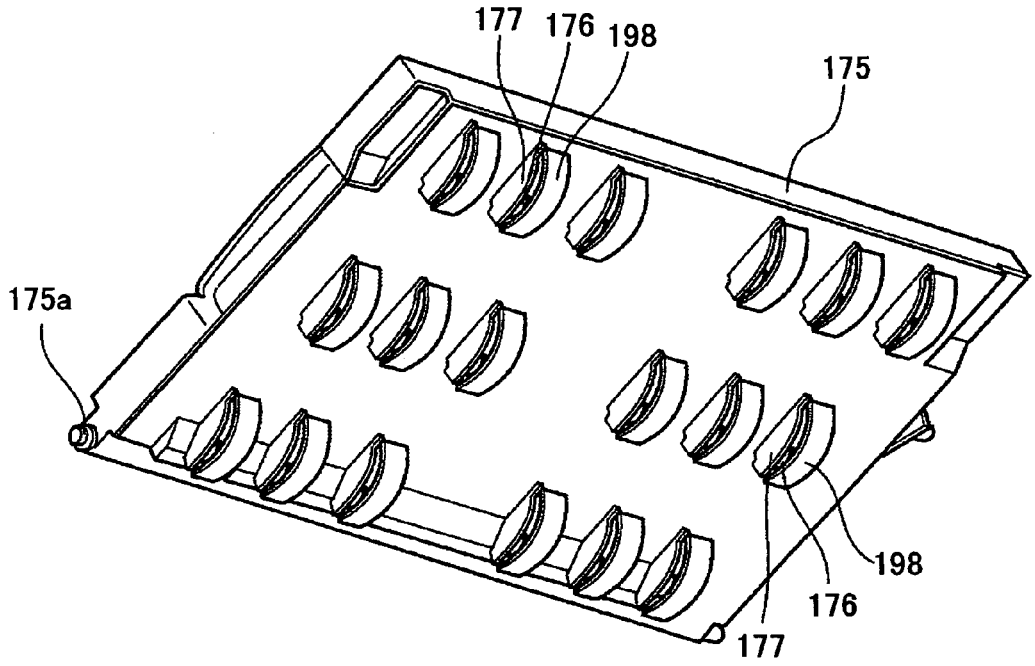
FIG. 19 is an oblique view diagram as viewed from a downward direction showing the same upper guide part of FIG. 18.

Next, a second embodiment of the present invention will be described with reference to FIGS. 14-19, wherein FIG. 14 is a schematic cross-sectional diagram of the sheet feed part in the state the upper guide part is closed, FIG. 15 is a schematic cross-sectional diagram showing the sheet feed part of FIG. 14 in the state the upper guide part is released, FIG. 16 is an oblique view diagram as viewed from the upward direction showing the upper guide part in the guiding position, FIG. 17 is an oblique view diagram as viewed from a downward direction showing the same upper guide part of FIG. 16, FIG. 18 is an oblique view diagram as viewed from an upward direction showing the upper guide part in the release position, and FIG. 19 is an oblique view diagram as viewed from a downward direction showing the same upper guide part of FIG. 18.

With the present embodiment, there are provided protective members 198 each having a plate like cover 198*a* covering the outer periphery of a corresponding spur 176 when in the protective position, in place of the protective members 178 of the previous embodiment. Otherwise, the present embodiment is identical to those explained previously and cumulative explanation will be omitted.

With such a construction, the upper guide part 74 is merely moved, in the event jamming of sheet 5 is caused in the transportation path 70 of the sheet discharging part 7, from the guide position shown in FIG. 14 to the release position shown in FIG. 15. Thereby, the sheet transportation path 70 is exposed as a result of separation of the upper guide part 74 from the lower guide part 73. Thereby, removal of the jammed sheet is achieved easily. Thereby, it is preferable to provide a mechanism for locking the upper guide part 74 at the release position.

Further, in this state, the protective members 198 causes rotation in the right direction in FIG. 14 in the downward reaction of the frame 175 as a result of disengagement with the flange part 170*a*. In this state, the protective members 198 proceed and cover the peripheral surface of the spurs 176 as shown in FIGS. 15 and 19, and protection is made to the spurs 176 with the protective members 178. With this, the problem of the jammed paper being caught by the spurs 176 during removal process thereof is eliminated, and maintenance of the image forming apparatus is facilitated.

Third Embodiment

Figure 20:
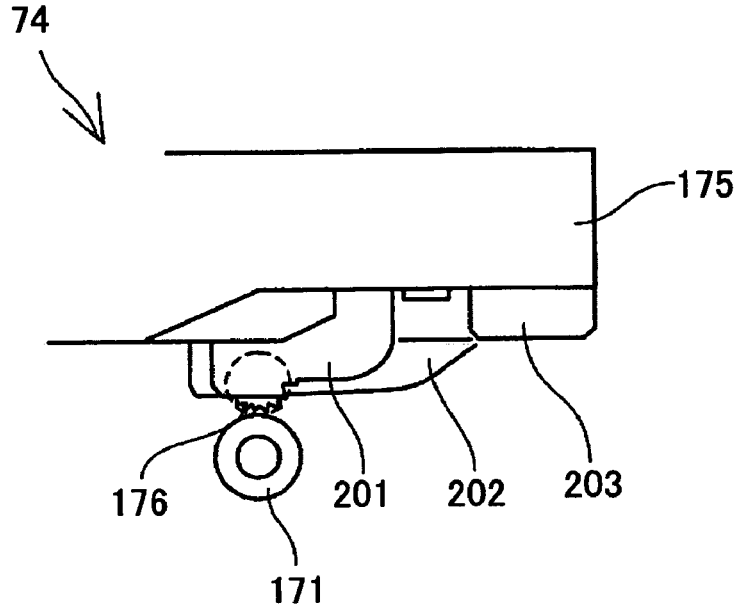
FIG. 20 is a schematic side view diagram showing a upper guide part according to a third embodiment of the present invention in the guiding position thereof.
Figure 21:
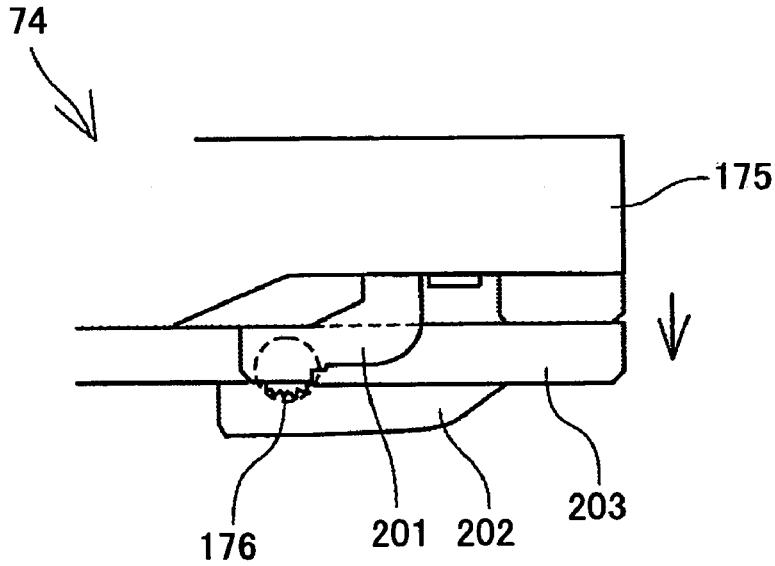
FIG. 21 is a schematic side view diagram showing the upper guide part in the release position thereof.
Figure 22:
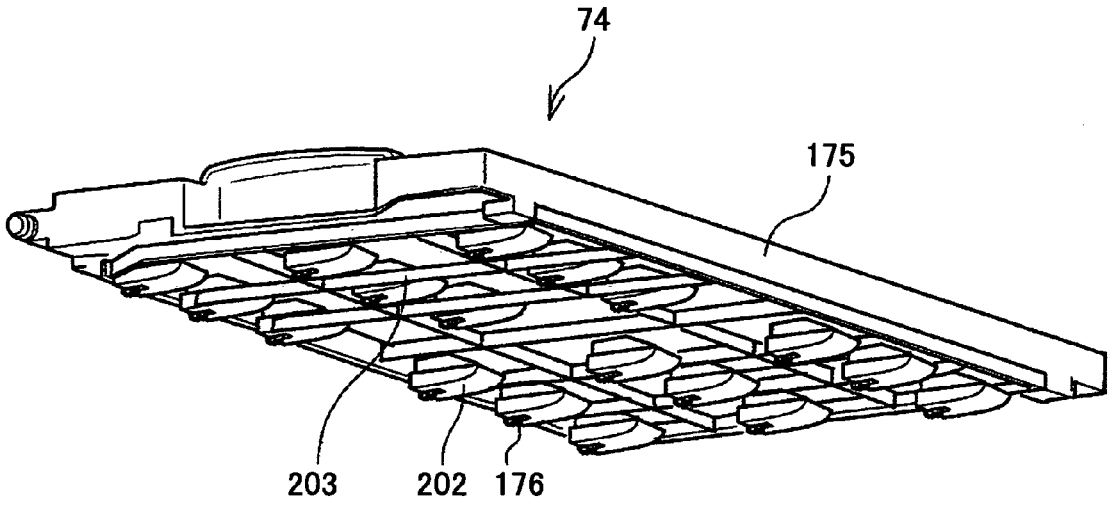
FIG. 22 is an oblique view diagram as viewed from a downward direction showing the upper guide part in the guiding position.
Figure 23:
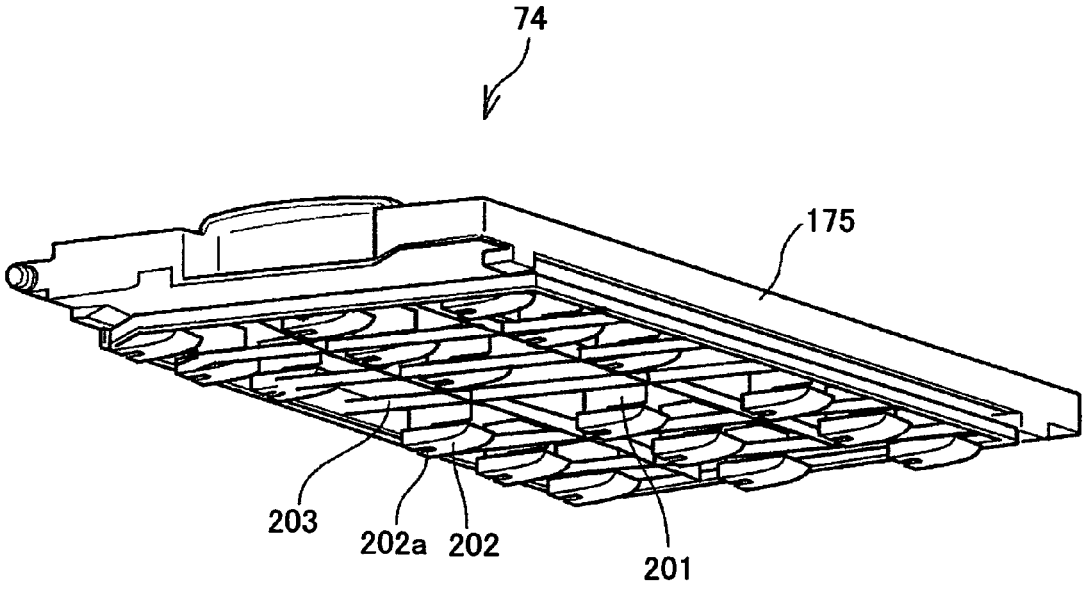
FIG. 23 is an oblique view diagram as viewed from a downward direction showing the upper guide part in the release position.

Next, a third embodiment of the present invention will be explained with reference to FIGS. 20-23, wherein FIG. 20 is a schematic side view diagram showing a upper guide part according to a third embodiment of the present invention in the guiding position thereof, FIG. 21 is a schematic side view diagram showing the upper guide part in the release position thereof, FIG. 22 is an oblique view diagram as viewed from a downward direction showing the upper guide part in the guiding position, and FIG. 23 is an oblique view diagram as viewed from a downward direction showing the upper guide part in the release position.

With this embodiment, the spurs 176 are held rotatably at the bottom surface of the frame 175 of the upper guide part 74 with a spur support plate 201, and there are provided protective members 202, which function as a guide member guiding the sheet 5 driven with the transportation roller 171 when the upper guide part 74 is in the guide position. Further, the protective members 202 are moved to the position forward of the spurs 176 when the upper guide part 74 is moved to the release position and provides protection to the spurs 176.

Thus, the protective members 202 are provided so as to face the sheet feed path 70 in the retracted state thereof retracted from the spurs 176 in the closed state of the upper guide part 74.

It should be noted that this protective members 202 are provided on a frame 203 movable to and from the frame 175 and are formed of a box-like member provided with a groove 202*a* at the downstream side of the sheet feed direction for allowing exposure of the respective spurs 176 therefrom.

Thus, in the retracted position in which the spurs 176 are exposed at the grooves 202*a*, the protective members 202 face the sheet feed path 70 in the retracted state from the spurs 176, while when the upper guide part 74 is moved to the release state, the protective members 202 are moved to the direction away from the frame 175 as shown in FIG. 22 and takes the protective position accommodating the spurs 176 therein.

Figure 24:
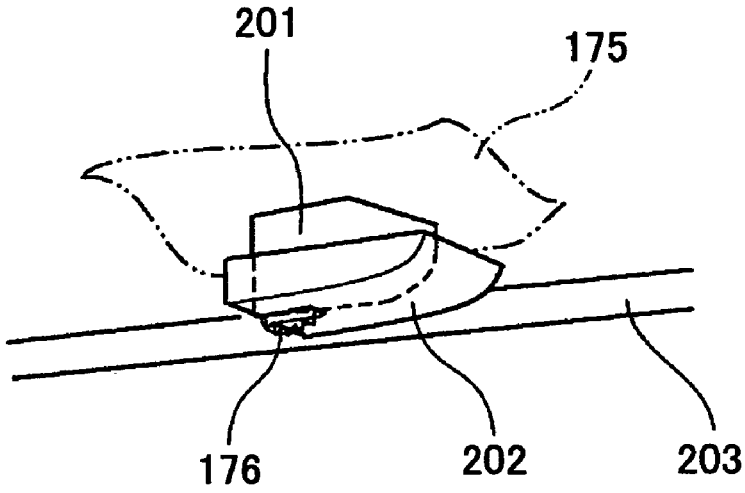
FIG. 24 is an enlarged oblique view diagram as viewed from a downward direction showing a part of the upper guide part in the guiding position thereof.

Here, it should be noted that the protective members 202 are provided to all of the spurs 176, and all of the protective members 202 are fixed upon the frame 203. Thus, with the displacement of the frame 203, all of the protective members 202 are moved between the retracted position where the protective members 202 function as a guide member as shown in FIGS. 20, 22 and 24 and a protective position shown in FIGS. 21, 23 and 25.

Figure 25:
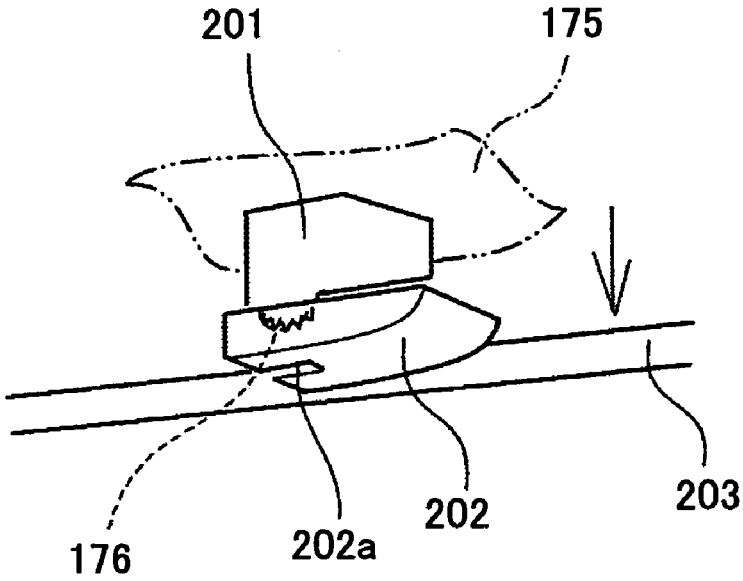
FIG. 25 is an enlarged oblique view diagram showing a part of the upper guide part in the release position thereof.

With such a construction, the frame 203 is moved away from the frame 175 in the direction of arrow as shown in FIGS. 21, 23 and 25 when the upper guide part 74 is moved from the guide position of FIGS. 20, 22 and 23 to the release position, and the spurs 176 are retracted to the respective protective members 202. Thereby, the protective members 202 protect the peripheral surface of the spur 176 by covering the peripheral surface.

With this, the problem of the jammed sheet being caught by the spurs 176 during the process of removal thereof is eliminated, and the maintenance of the image forming apparatus is facilitated.

Further, while the foregoing explanation has been made for the case the protective members are moved to the protective position with the swinging motion of the upper guide part by the weight of the protective members themselves or with engagement or disengagement with other members, it is also possible to cause displacement of the protective members with manual operation when the upper guide part is moved to the release position.

Further, while the foregoing explanation is made for the case of the protective members causing rotation by the gravity with cancellation of engagement with other members, it is also possible to construct such that the protective members are moved to the protective position by engagement of the lever 183 with other members when the upper guide part is moved to the release position.

Further, the present invention is by no means limited to the embodiments described heretofore, but various variations and modifications may be made without departing from the scope of the invention.

The present invention is based on Japanese priority application No. 2004-271486 filed on Sep. 17, 2005, which is incorporated herein as reference.

What is claimed is:

1. An image forming apparatus, comprising:

a recording head ejecting droplets of a recording liquid to a recording medium;

a medium transportation mechanism transporting said recording medium along a medium feed path, said medium feed path including a recording position where recording is made with said recording head, said medium feed path including a medium taking-up part at a downstream side of said recording position; and a guide part guiding transportation of said recording medium in said medium taking-up part, said guide part carrying plural spurs arranged in a direction of said medium feed path and further in a direction perpendicular to said medium feed path for holding said medium on which recording has been made at said recording position, said guide part being movable between a guide position in which said spurs are engaged with said recording medium and a release position in which said spurs are disengaged from said recording medium, wherein there are provided a plurality of protective members to said guide part such that said plural protective members are movable between a protective position protecting said plural spurs and a retracted position retracted from said spurs, each of said plural protective members accommodating therein a corresponding spur when in said protective position.

2. The image forming apparatus as claimed in claim 1, wherein said protective member is a plate member and is located, when said protective member is in said retracted position, at a side away from said medium take-up part of said medium feed path with respect to said guide part.

3. The image forming apparatus as claimed in claim 2, wherein said protective member comprises a plate member covering an outer peripheral surface of said spurs when said protective member is in said protective position.

4. The image forming apparatus as claimed in claim 2, wherein said protective member comprises a plate member located at both lateral sides of each spurs when said protective member is in said protective position.

5. The image forming apparatus as claimed in claim 1, wherein said protective member moves to said protective position by causing a rotation.

6. The image forming apparatus as claimed in claim 1, wherein said protective member faces said medium take-up part of said medium feed path in a state retracted from said spurs when said protective member is in said retracted position.

7. The image forming apparatus as claimed in claim 6, wherein said protective member moves to said protective position by causing any of a movement away from said guide part and a movement along said guide part.

8. The image forming apparatus as claimed in claim 1, wherein said protective member is moved to said protective position when said guide part is moved from said guide position to said release position, said protective member being moved to said protective position by way of any of gravity, engagement with other member and disengagement from other member.

9. The image forming apparatus as claimed in claim 1, wherein said protective member is moved by a manual operation.

10. The image forming apparatus as claimed in claim 1, wherein each of said plural protective members is a box-like member.

11. The image forming apparatus as claimed in claim 1, wherein each of said plural protective members covers an outer periphery of a corresponding spur.

* * * * *